US006176739B1

(12) United States Patent
Denlinger et al.

(10) Patent No.: US 6,176,739 B1
(45) Date of Patent: Jan. 23, 2001

(54) SEALED ELECTRICAL CONDUCTOR ASSEMBLY

(75) Inventors: Keith Robert Denlinger, Lancaster, PA (US); Ralf Jaklin, Liederbach (DE); John Mark Myer, Millersville, PA (US)

(73) Assignee: The Whitaker Corporation, Wilmington, DE (US)

( * ) Notice: Under 35 U.S.C. 154(b), the term of this patent shall be extended for 0 days.

(21) Appl. No.: 09/026,350

(22) Filed: Feb. 19, 1998

Related U.S. Application Data

(60) Provisional application No. 60/037,971, filed on Feb. 20, 1997, and provisional application No. 60/041,617, filed on Mar. 27, 1997.

(51) Int. Cl.[7] ..... H01R 13/40
(52) U.S. Cl. ..... 439/589
(58) Field of Search ..... 439/587, 589, 439/274, 275, 279; 277/604, 607, 615, 626

(56) References Cited

U.S. PATENT DOCUMENTS

| | | | | |
|---|---|---|---|---|
| 4,084,875 | | 4/1978 | Yamamoto | 339/94 |
| 4,109,989 | | 8/1978 | Snyder et al. | 339/94 |
| 4,441,777 | * | 4/1984 | Harootion | 339/94 |
| 4,944,688 | | 7/1990 | Lundergan | 439/275 |
| 4,998,896 | | 3/1991 | Lundergan | 439/595 |
| 5,538,441 | * | 7/1996 | Paolucci et al. | 439/589 |
| 5,593,326 | * | 1/1997 | Listing | 439/752 |
| 5,839,920 | * | 11/1998 | Yurko et al. | 439/587 |

FOREIGN PATENT DOCUMENTS

| | | |
|---|---|---|
| 1 465 485 | 5/1969 | (DE) . |
| 0 625 807 A2 | 11/1994 | (EP) . |

OTHER PUBLICATIONS

Patent Abstracts of Japan, vol. 096, No. 005, May 31, 1996 Publication No. 08007964, Application No. 06299608, Publication Date Dec. 1, 1996.

International Search Report, International application No. PCT/US98/03288, International filing date, Feb. 17, 1998.

* cited by examiner

*Primary Examiner*—Neil Abrams
*Assistant Examiner*—Michael C. Zarroli

(57) ABSTRACT

An electrical connector assembly 10 includes a seal 20 including sealing apertures 25 that including glands for sealing a wire extending through the aperture. A sealing unit 24 includes a lead in recess 26, a contact ingress seal gland 28, a core seal gland 30 and a contact egress seal gland 29. The core seal gland 30 establishes the primary seal with a wire extending through the seal, and the ingress seal gland 28 is deformable between the core seal gland 30 and the contact during contact insertion to protect the core seal gland 30 from damage. A pattern 40 of stress relieving recesses 42 et seq. surrounds the seal apertures, and include canted webs 43 et seq. The stress relieving recesses aid flexure of the seals and the seal glands. Other stress relieving recesses 56 located between seal apertures including perpendicular webs 57.

23 Claims, 8 Drawing Sheets

SEALED ELECTRICAL CONDUCTOR ASSEMBLY

CROSS REFERENCE TO CO-PENDING APPLICATION

This application claims the benefit of U.S. Provisional Application(s) No(s). 60,037,971, Filed Feb. 20, 1997 and Provisional Application No. 60/041,617, Filed Mar. 27, 1997.

This application claims the benefit of Provisional Application 16902L, filed Feb. 20, 1997 entitled Sealed Electrical Conductor Assembly, and the benefit of Provisional Application 16906L, entitled Sealed Electrical Conductor Assembly filed Mar. 27, 1997.

BACKGROUND OF THE INVENTION

1. Field of the Invention

The present invention relates to an electrical conductor assembly comprising a seal for sealing an electrical conductor terminated to an electrical contact. The seal of the present invention allows a contact having corners, e.g. a box-shaped receptacle contact, to be manually or automatically inserted through the seal without degrading the sealing quality of the seal.

2. Description of the Prior Art

Seals are often used with electrical connectors to provide a barrier to contaminants, including water and other fluids. Seals are typically located at the mating interface between two electrical connectors and around conductors, typically wires, that extend into the connector. Typically, the wires are attached to electrical terminals and the terminals are then inserted into terminal cavities in electrical connector housings. The terminals are inserted through terminal receiving apertures or holes in the seals and into corresponding cavities in the housing. These holes in the seals typically includes sealing glands or cylindrical bumps or protuberances that establish sealing integrity with the round wires or conductors extending though the seals when the terminals have been fully inserted into the housing cavities.

The terminals are typically larger than the conductors to which they are attached. Therefore one problem that occurs is that during insertion of the terminal or electrical contact through the seal holes or apertures, the contact can damage the seal glands. For example, the front end of the contact can tear the seal, thereby compromising the sealing capability of the seal. The problem is especially significant for typical terminals or contact having a box shaped receptacle section with a generally rectangular or square cross section. The round hole must be deformed to allow the rectangular terminal to pass through the seal. During insertion, the edges of the terminal or contact can bite into the seal and rip or tear the seal.

SUMMARY OF THE INVENTION

A primary object of the sealing assembly and the seal depicted herein is to provide a good barrier to contaminants, including fluids, and to reduce the damage to seals as electrical contacts or terminals are inserted through the seal apertures. This seal is especially adapted for use with box contacts or receptacles having a rectangular cross section that are inserted through round apertures or holes.

In accordance with this invention, a sealed electrical conductor assembly includes a seal having a seal surface with at least one a contact receiving aperture extending into the seal from the seal surface for receiving said contact and said conductor therethrough. A lead-in recess is formed on the seal surface adjacent to the contact receiving aperture for receiving said contact. The contact receiving aperture comprises a plurality of sealing glands including an ingress gland and a core gland. As the contact is inserted into a contact receiving aperture, the contact is operative to push the ingress gland into engagement with the core gland. The ingress gland is interposed between the core gland and a corner area of the contact. The ingress gland thereby protects the core gland from tearing as the contact is inserted through the seal.

DETAILED DESCRIPTION OF THE INVENTION

Figure 1:
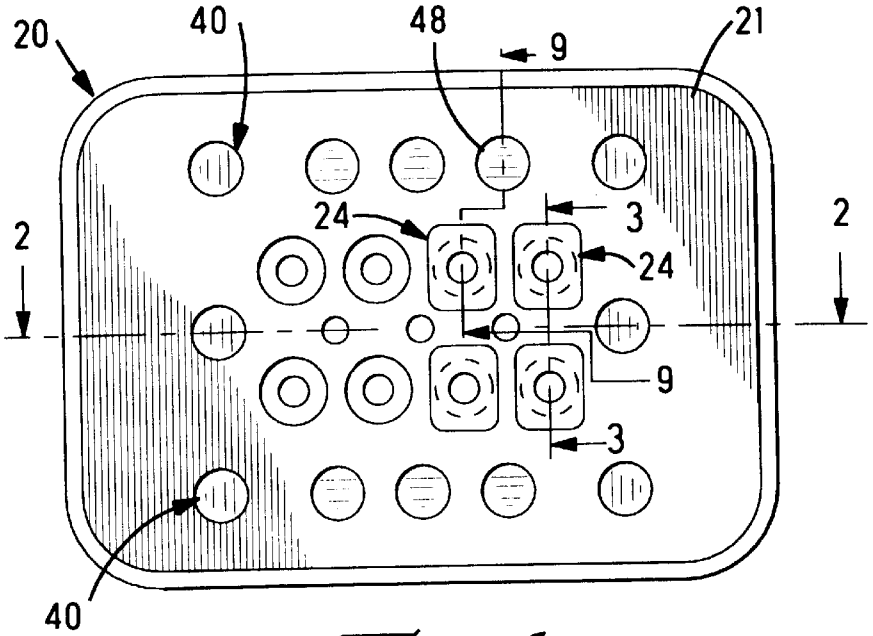
FIG. 1 shows a front view of a seal according to the present invention.
Figure 2:
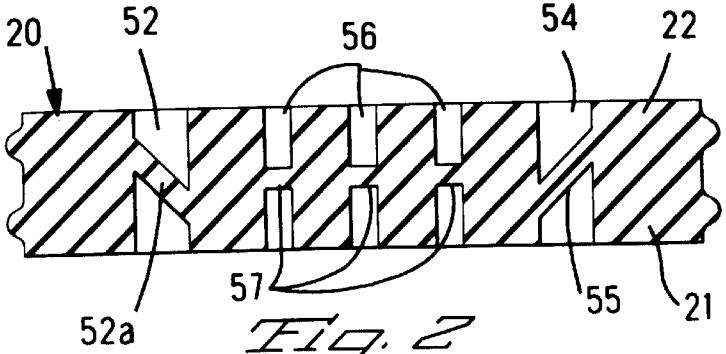
FIG. 2 shows a cross section of the seal of FIG. 1 taken along line 2—2.
Figure 13:
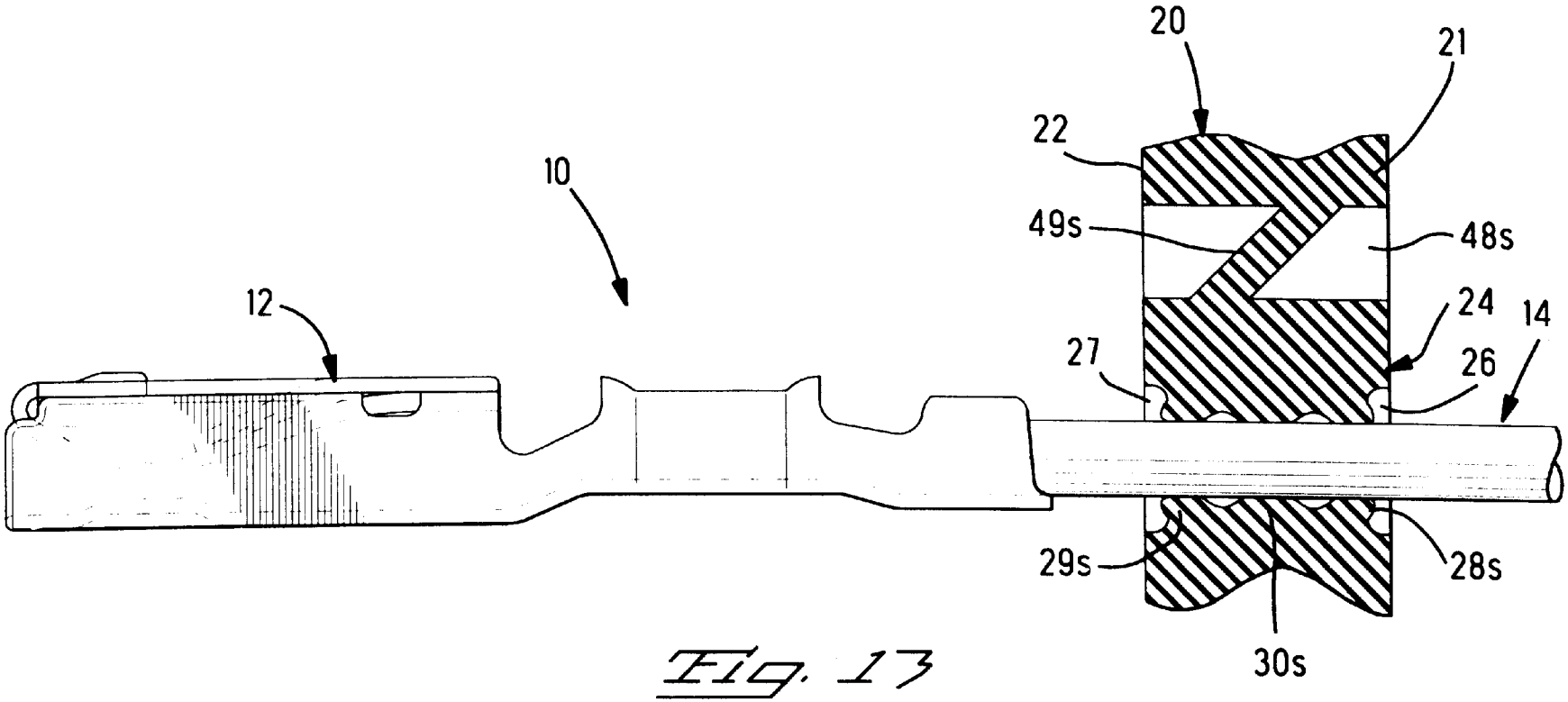
FIG. 13 shows a side view of the assembly of the present invention in a completed state.
Figure 14:
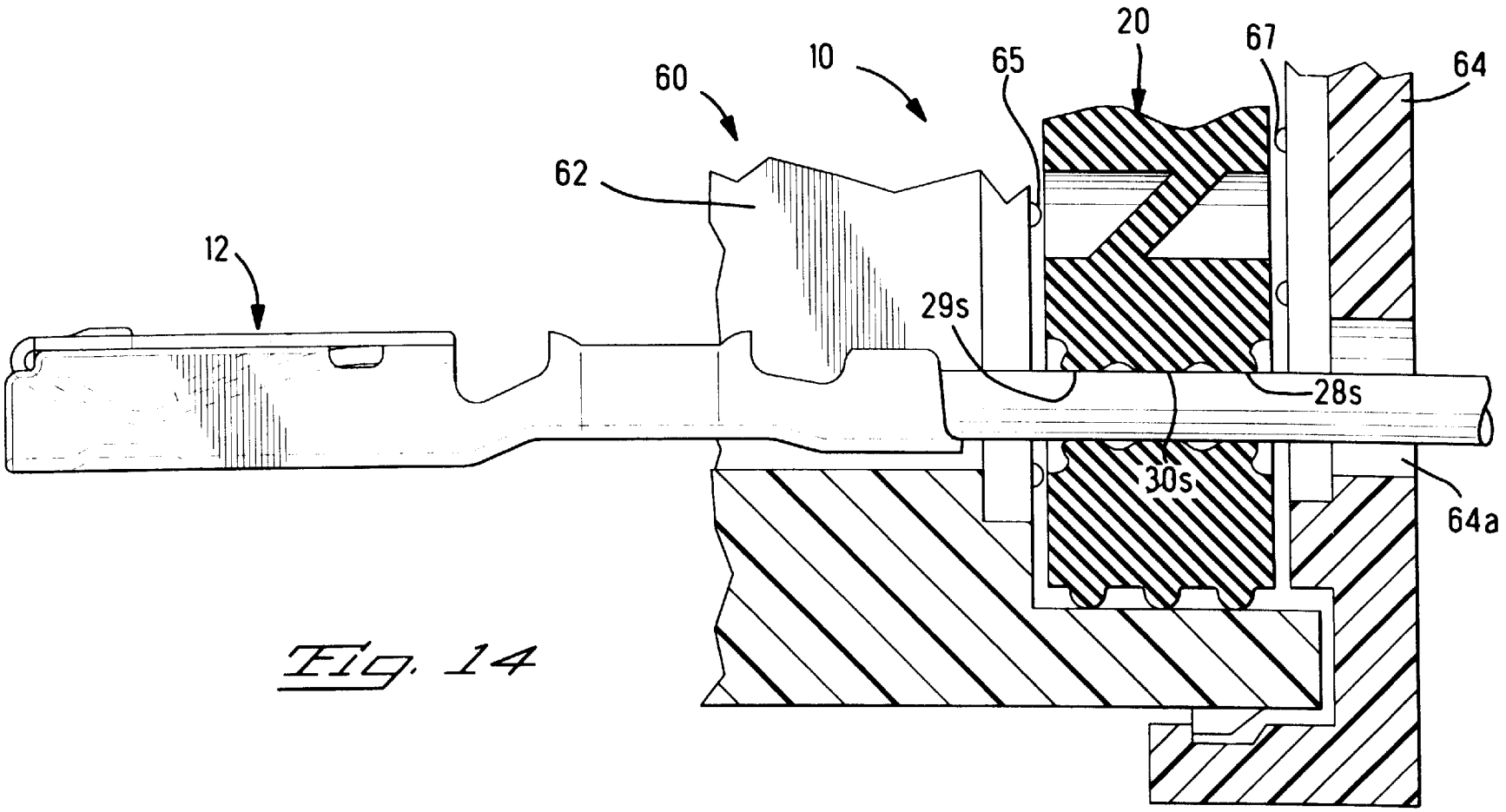
FIG. 14 shows the assembly of the present invention installed in a housing assembly.

Referring to FIGS. 1 and 13, a sealed conductor assembly 10 according to the present invention will be described. Sealed assembly 10 includes a wire seal 20, and an electrical contact 12 terminated in a conventional fashion to a conductor 14. Sealed conductor assembly 10 is suitable for being housed within a contact receiving area of an electrical connector housing assembly 60 (FIG. 14). As indicated in FIGS. 13–14, seal 20 is in sealing engagement with conductor 14 thereby creating a sealed barrier, which barrier advantageously inhibits the influx of foreign matter into the contact receiving area of electrical connector housing 60.

Figure 3:
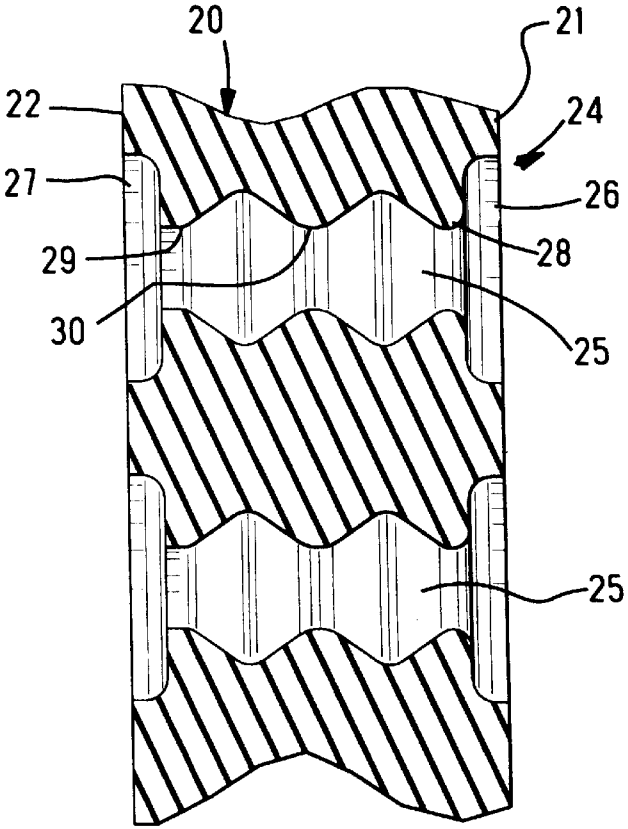
FIG. 3 shows a cross section of the seal of FIG. 1 taken along line 3—3.
Figure 8:
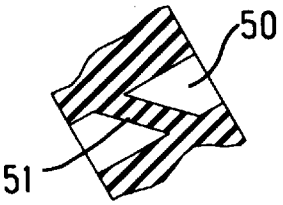
FIG. 8 shows a cross section of the seal of FIG. 4 taken along line 8—8.
Figure 7:
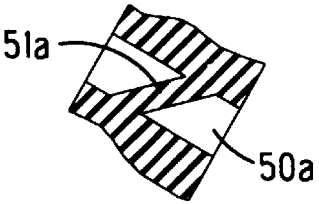
FIG. 7 shows a cross section of the seal of FIG. 4 taken along line 7—7.
Figure 4:
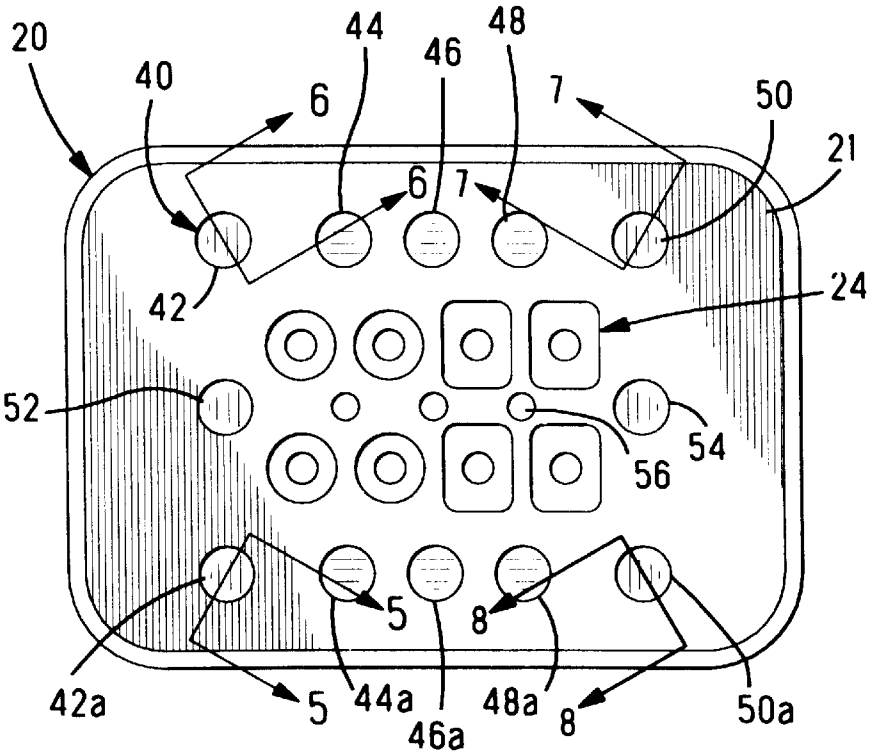
FIG. 4 shows the seal of FIG. 1.
Figure 5:
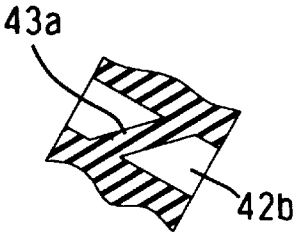
FIG. 5 shows a cross section of the seal of FIG. 4 taken along line 5—5.
Figure 6:
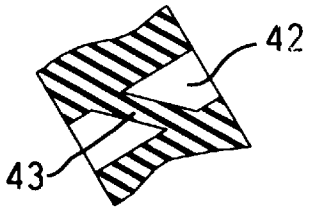
FIG. 6 shows a cross section of the seal of FIG. 4 taken along line 6—6.
Figure 9:
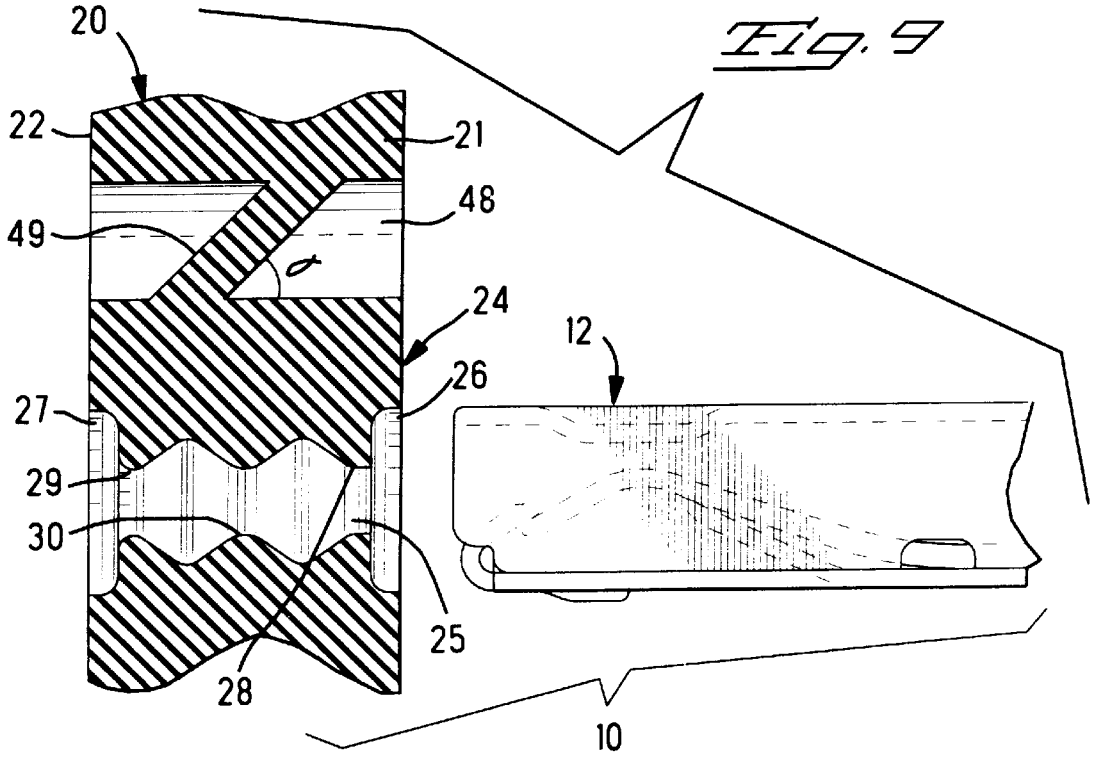
FIG. 9 shows a side view of the seal and contact components of the assembly of the present invention in a pre-staged position.

Now referring to FIGS. 1–8, seal 20 will be further described. Seal 20 is formed of a sealing material, of about 50 durometer, preferably 30 durometer, or most preferably 18 durometer. Seal 20 includes first and second exterior surfaces 21 and 22, respectively. Extending through the seal between exterior surfaces 21,22 are a plurality of sealing units 24. A given sealing unit 24 comprises a contact/conductor receiving aperture 25. Adjacent to aperture 25 and formed in exterior surfaces 21,22 are a lead-in recess 26 and an exit recess 27 (FIG. 3). In the present embodiment, recesses 26,27 comprise a generally box-shaped form, complementary to the contours of contact 12, which is preferably a box-shaped receptacle contact. Sealing unit 24 also includes sealing sections comprising a contact ingress gland 28 adjacent to lead-in recess 26, a contact egress gland 29 adjacent exit recess 27, and a core gland 30 disposed between glands 28,29 (FIG. 3). Seal 20 also includes a stress relieving pattern 40 comprising stress relieving recesses 42,42*a*,44,44*a*,46, 46*a*,48,48*a*,50,50*a*,52,54,56 (FIG. 4). As best shown in FIGS. 2 and 4–8, recesses 42,42*a*,44,44*a*,46, 46*a*, 48,48*a*,50,50*a*,52,54 comprise major recesses located adjacent sealing units 24. The major recesses of pattern 40 are strategically spaced between the outer periphery of seal 20 and sealing units 24. Each major recess comprises a respective canted web 43,45,47,49, 51,53,55 which extends across the respective major recess (FIGS. 2 and 5–9). The cant of each web is made such that the portion of the major recess web which is adjacent a given sealing unit 24 is contiguous with a wall of the major recess adjacent respective egress and core glands 29,30, which advantageously permits a high degree of deformation of the major recess in the area of ingress gland 28, as will be further described below. Each major web has a facing portion which faces toward exterior surface 21, and a facing portion which faces exterior surface 22. The facing portion of a given major web nearest a given sealing unit 24 defines an acute angle $\alpha$ with respect to a wall of the respective major recess, e.g. as shown in FIG. 9. Thus, the cant of a web 43,45,47,49,51,53,55 traverses its respective major recess, toward exterior surface 21, as the web extends away from an adjacent sealing unit 24. Additionally, pattern 40 comprises a row of minor recesses 56, each including a respective transverse web 57 extending thereacross. Minor recesses 56 are strategically located between certain ones of the sealing units 24 for stress relieving action, as will be further described below.

Figure 10:
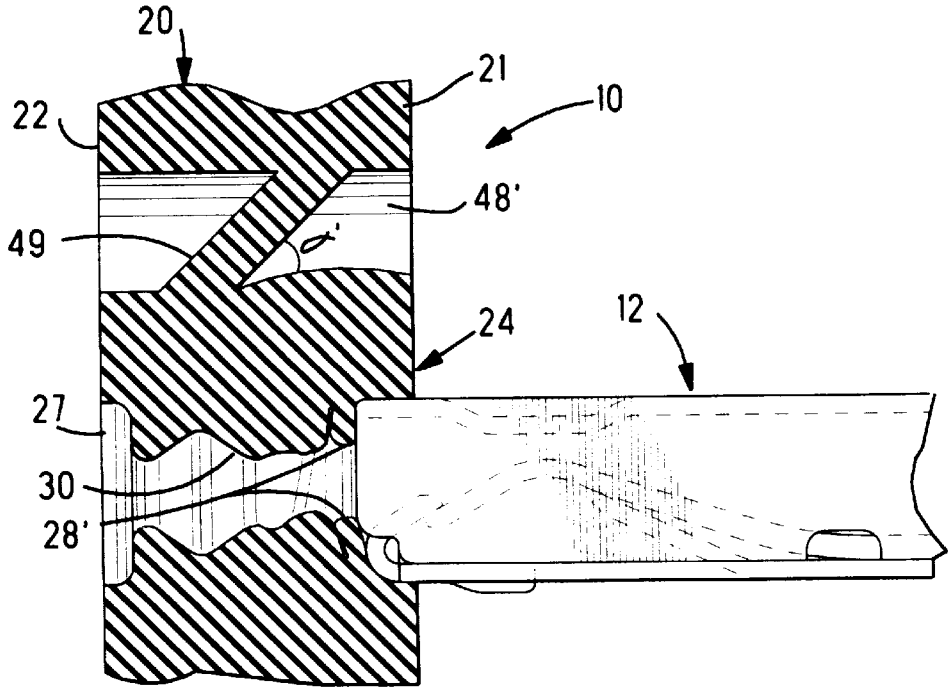
FIG. 10 shows initial insertion of the contact into the seal.

Assembly of sealed conductor assembly 10 will now be described. As shown in FIG. 9, contact 12 is in a pre-staged position with respect to a sealing unit 24 so that the complementary shape of lead-in recess 26 is aligned with the face of contact 12. Contact 12 is then inserted into lead-in recess 26, which recess serves to align and position contact 12 with respect to aperture 25, as shown in FIG. 10. The generally flat surface of gland 28 is pushed by the face of contact 12, with gland 28 folding and stretching in response, whereby contact ingress gland 28 is stretched into a protective, stretched gland state 28' around contact 12 but between contact 12 and core gland 30. However, it is to be understood that recesses 26 and 27 are not required to be formed in exterior surfaces 21,22, but the invention hereof will perform satisfactorily where glands 28 and 29 are substantially coterminous with exterior surfaces 21 and 22, respectively. As contact 12 is further inserted into sealing unit 24, ingress gland 28 is elastically stretched about contact 12 into a protective, extended gland state 28". Extended gland state 28" is thereby interposed between contact 12 and core gland 30. Core gland 30 becomes pressed into a deformed state 30' thereby allowing contact 12 to pass. At this point, core gland 30 has been shielded from tearing engagement with contact 12 by the protective stretched and extended gland states 28',28". The stretched and extended states of gland 28 are effected by the durometer characteristic of the material from which seal 20 is made, which is most preferably a characteristic of about 18 durometer. According to the present invention, whether or not ingress gland 28 is torn during insertion of contact 12, core gland 30 is protected by the compressed and extended gland states 28',28" as contact 12 is inserted through seal 20. Extraction of contact 12 from seal 20 will result in generally a reversal of the foregoing, i.e. gland 29 will be stretched over core gland 30 by the rear portion of contact 12, thereby protecting core gland 30 from tearing during removal of contact 12.

Figure 11:
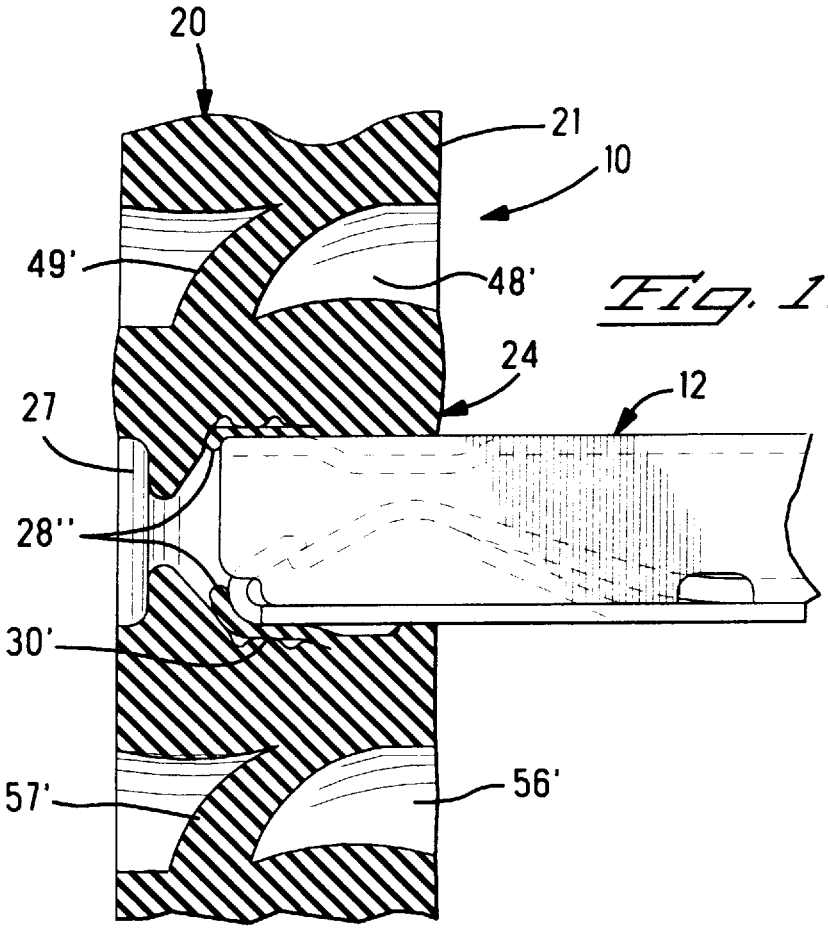
FIG. 11 shows a first intermediate insertion position of the contact into the seal.

Moreover, as contact 12 is inserted in sealing unit 25, stress relieving pattern 40 is operative to relieve stress in the material of seal 20 by allowing the seal material to flow away from a given sealing unit 20 when contact 12 is being inserted therethrough. As contact 12 presses on lead-in gland 28, the seal material is compelled to flow toward adjacent major and minor recesses of pattern 40. As best shown in FIG. 11, and using major recess 48 and minor recess 56 as illustrative examples, upon insertion of contact 12 the seal material flows toward adjacent recesses 48,56 of pattern 40, whereby the respective internal dimensions of which are changed as indicated at 48',56'. Additionally, webs 49,57 are deformed under stress to bow, as shown at 49',57' of FIG. 11. Additionally, angle $\alpha$ is squeezed to generally a lesser angle $\alpha'$. Thus, because the seal material of seal 20 is permitted to flow into the major and minor recesses, stress is advantageously relieved therein sufficient enough to avoid a stress build-up in the seal material in excess of its tear strength.

Figure 12:
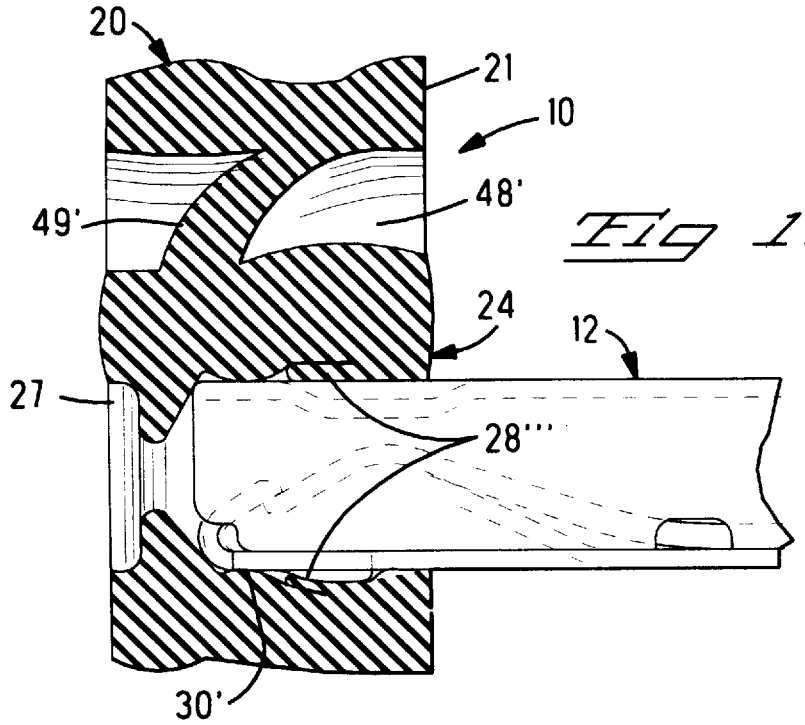
FIG. 12 shows a second intermediate insertion position of the contact into the seal.

As shown in FIG. 12, further insertion of contact 12 through sealing unit 24 results in elastic regression of ingress gland 28 as shown at 281'"; however, core gland 30 is not torn but, as described above, remains fully intact for performing its sealing function. After contact 12 has been fully inserted through seal 20, as indicated by FIG. 13–14, sealing glands 28,29,30 assume respective sealing postures 28*s*,29*s*,30*s*, with respect to conductor 14. Preferably, as shown in FIG. 14, assembly 10 is made according to the foregoing description in a housing assembly 60. Housing assembly 60 comprises a housing 62, a latchable cover 64 having a contact receiving aperture 64*a*. Spacers 65,67, of a suitable thickness, are formed on housing 62 and cover 64, respectively, for allowing space to remain between seal 20 and housing 62 and cover 64, respectively. This reservation of space allows the seal material to flow, in the front and back of seal 20, as contact 12 is inserted through hole 64*a* and aperture 25.

In the present invention, the sealing integrity of core gland 30 is preserved as a primary sealing gland, even if ingress gland 29 has been torn by insertion of contact 12. In this way, ingress gland 29, if torn by the insertion process of contact 12, is a sacrificial gland which is stretchably sacrificed in order to protect core gland 30. Moreover, the final state of electrical conductor assembly 10 is compact because it does not require a funnel-type lead-in recess.

Figure 15:
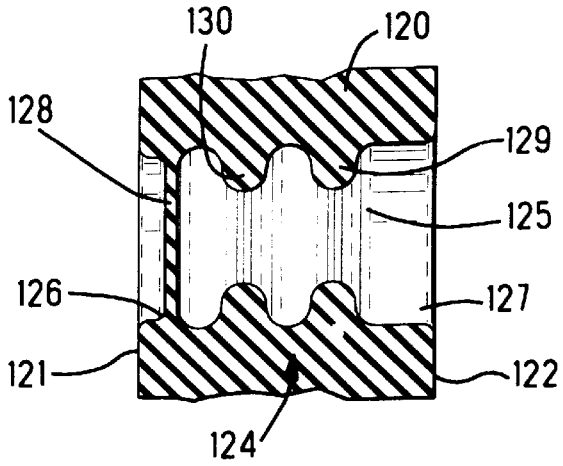
FIG. 15 shows a cross section of an alternative embodiment of the seal.
Figure 16:
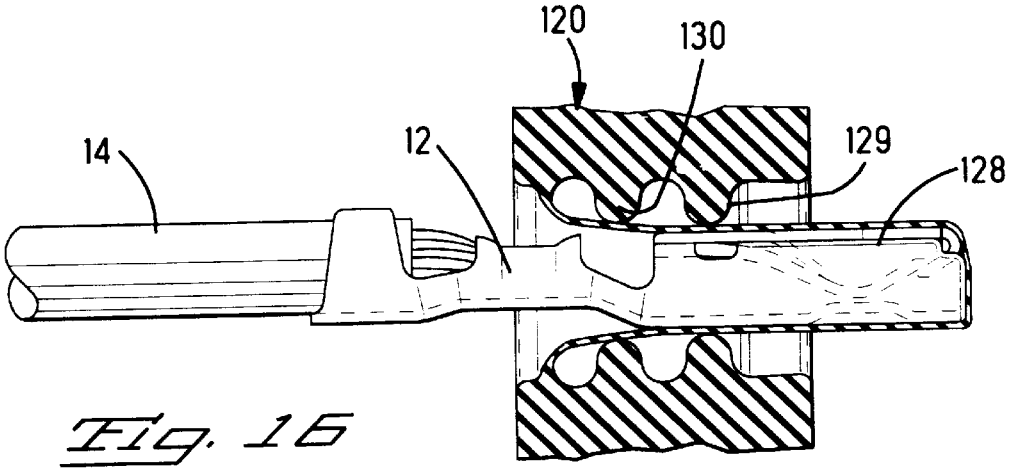
FIG. 16 the insertion of the contact into the seal of FIG. 15.
Figure 17:
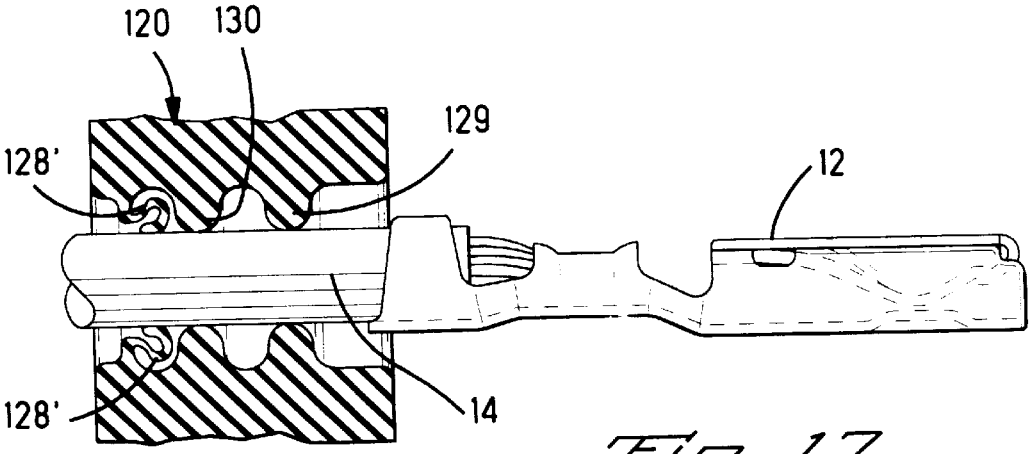
FIG. 17 shows the full insertion position of the contact into this field.

Referring to FIGS. 15–17, a second embodiment of the seal will now be described. Seal 120 is suitable for use as a sealed assembly around an electrical contact 12 and the conductor 14 terminated thereto. Seal 120 is formed of a similar;r sealing material as was described earlier for seal 20. Seal 120 includes first and second exterior surfaces 121 and 122 respectively. A given sealing unit 124 has a contact/conductor receiving aperture 125. Adjacent to aperture 125 and formed in exterior surfaces 121, 122 are lead-in recesses 126 and exit recess 127. The recesses 126, 127 comprise a generally box shaped form, complimentary to the contours of contact 12 which is a box shaped receptacle contact. Alternatively, the seal of the present invention can be used for a round contact also. The contact receiving aperture 125 is generally round shaped to a good sealing surface against the round conductor 14. The contact receiving aperture 125 has a first, frangible gland 128. The seal 120 also has an egress gland 129 and a core gland 130.

During assembly of the contact 12 to the connector, the contact is received into lead-in recess 126 against the frangible gland 128. As the contact 12 is inserted further into the connector and through the seal 120, to the right as shown in FIG. 16, the frangible gland 128 stretches along the surface of the contact 12 as it is inserted through the aperture 125. When the contact 12 is inserted far enough into the connector, the frangible gland 128 will be stretched beyond its limits and will break forming broken glands 128'. The broken glands 128' will spring back towards their original position within the seal 120.

As the contact is being inserted through the seal, as shown in FIG. 16, the frangible gland 128 stretches around the contact 12 thereby protecting the core gland 130 and the egress gland 129 from damaging the engaging glands 129 and 130 and thereby scratching or cutting glands 129, 130. Therefore, the frangible glands 128 serves to protect the sealing ability of glands 129, 130. Because the glands were protected during the insertion, they provide a good seal against the wire or conductor 14 once the contact is fully inserted into the connector housing.

Figure 18:
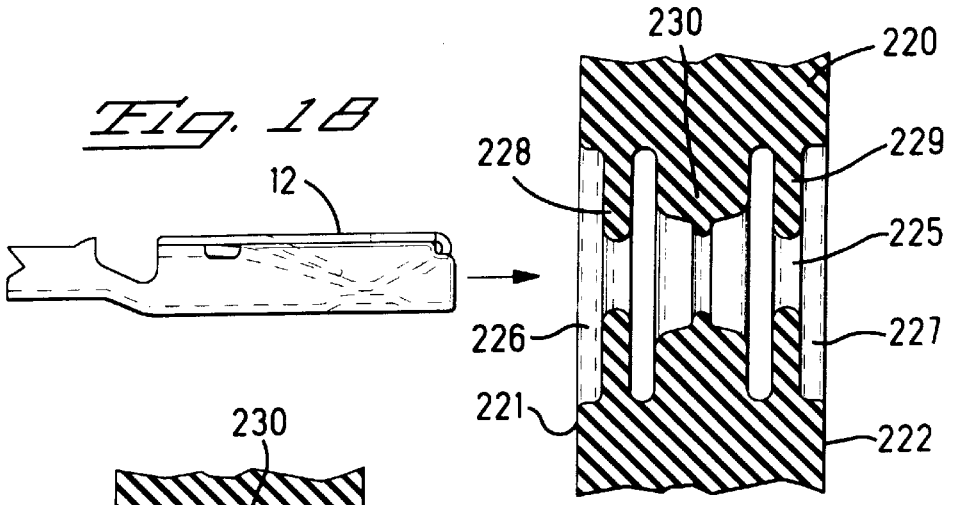
FIG. 18 shows a cross sectional view of an alternative embodiment of the seal of the present invention.

Now referring to FIGS. 18–21, an alternative embodiment of the present invention will now be described. FIG. 18 shows an alternative embodiment of the seal which can be used in an electrical connector to provide a seal around the wires or conductors thereof. The seal 220 has exterior surfaces 221 and 222. The seal 220 also has a contact/conductor aperture 225 extending therethrough. Adjacent to aperture 225 and formed in exterior surfaces 221, 222 are a lead in recess 226 and an exit recess 227. Along the contact receiving aperture 225 are a series of glands, ingress gland 228, egress gland 229, and core gland 230. In this embodiment, core gland 230 is substantially wider than ingress and egress glands 228, 229. This gives the core gland 230 better strength and durability to hold up to tears and also to provide a better sealing surface against the wires or conductors.

Figure 19:
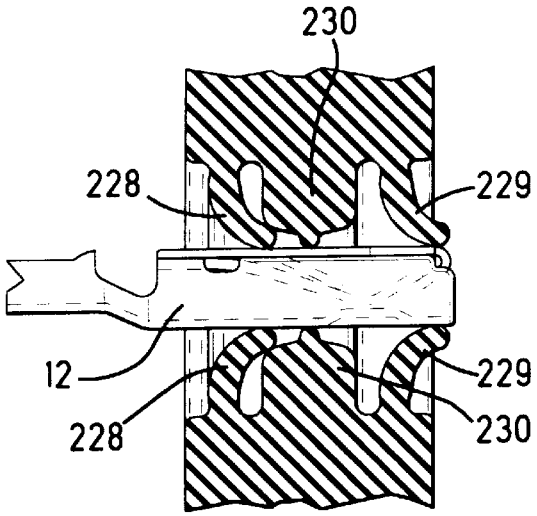
FIG. 19 shows the insertion of a contact into the seal of FIG. 18.
Figure 20:
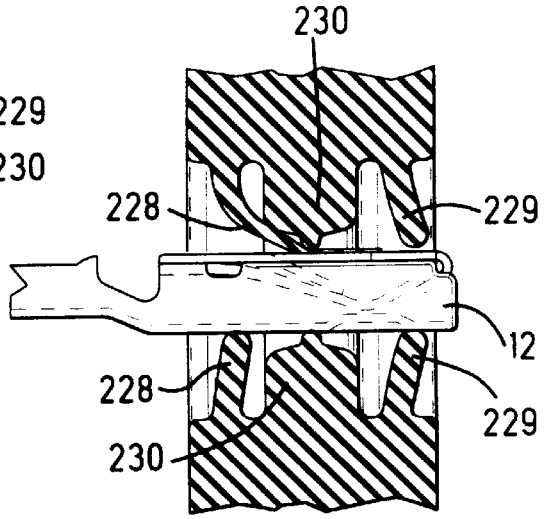
FIG. 20 shows an alternative manner in which the contact may be inserted into the seal of FIG. 18.
Figure 21:
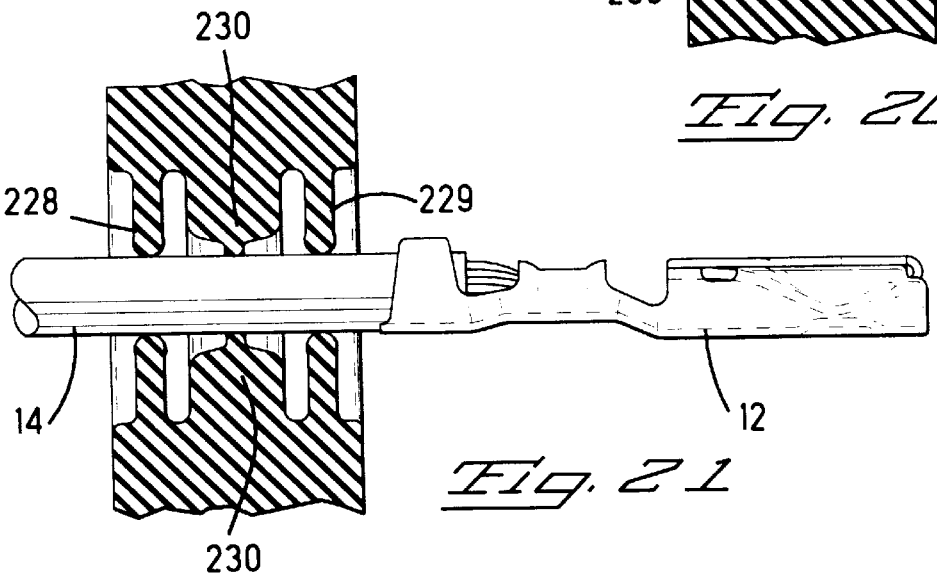
FIG. 21 shows the contact in the fully inserted position.

During insertion of the contact through the contact receiving aperture 225, the ingress gland 228 will be pushed towards the opposite side of the seal 220, as shown in FIG. 19, and will provide a protective surface for the core gland 230 during insertion of the contact. The ingress gland 228 will bear the force of any tears or scratches during contact insertion thereby protecting the core gland 230. Alternatively, as shown in FIG. 20, the ingress gland can be pushed and stretched by the contact 12 if the contact 12 stubs on the gland during insertion thereby pushing it past the core gland 230. The ingress gland 228 would then form a protective barrier against the core 230 to prevent cuts and scratches on the core gland to 230. This allows better sealing of the core gland 230 against the wire upon full insertion of the contact into the connector housing. The ingress gland 228 acts as a sacrificial gland during the insertion process of the contact 12 into the aperture 225. By absorbing the cuts and scratches that occur during insertion of the contact 12, the ingress gland protects the core gland 230 from these cuts and scratches and, therefore, allows the core gland 230 to provide a better sealing surface against the conductor 14 when the contact is fully inserted within the electrical connector.

When the contact 12 is removed from the electrical connector, the rear portion of the contact 12 will engage the egress gland 229. The egress gland will serve to protect the core gland 230 from cuts and scratches in the same manner as the ingress gland 228 protects during insertion. Therefore, the seal 220 can be reused as the core gland 230 will remain intact and can provide a good seal against a conductor 14 after a subsequent insertion.

The seal of the present invention allows a contact having corners, e.g. a box-shaped receptacle contact, to be manually or automatically inserted through the seal without degrading the sealing quality of the seal.

The seal of the present invention and many of its attendant advantages will be understood from the foregoing description. It is apparent that many changes may be made in the form, construction, and arrangement of parts thereof without departing from the spirit or scope of the invention, or sacrificing all of their material advantages.

What is claimed is:

1. A sealed electrical connector assembly for use with electrical contacts attached to wires, the assembly including an electrical connector with a seal having apertures, extending through the seal, through which electrical contacts attached to wires pass when the electrical contacts are inserted into the electrical connector, the seal including sealing glands extending into each aperture, at least one aperture including a core seal gland for sealing around a wire extending therethrough, the electrical connector assembly being characterized by an ingress seal gland deformable during passage of an electrical contact through said aperture into a position between the corresponding core seal gland and the contact to prevent damage to the core seal gland by the contact.

2. The sealed electrical connector assembly of claim 1 wherein the seal includes stress relieving recesses adjacent the at least one aperture, the stress relieving recesses aiding deformation of the seal glands in the at least one aperture so that the ingress seal gland is deformed into a position between the corresponding core seal gland and the contact to prevent damage to the core seal gland by the contact.

3. The sealed electrical connector assembly of claim 2 wherein the stress relieving recesses provide clearance to permit the core seal gland to recede from the contact so that the ingress seal gland can be positioned between the core seal gland and the contact.

4. The sealed electrical connector assembly of claim 2 wherein each stress relieving recesses includes coaxial sections extending inwardly from opposite sides of the seal, each stress relieving recess including a web spanning the stress relieving recess.

5. The sealed electrical connector assembly of claim 4 wherein at least one stress relieving recess includes a canted seal web extending at an acute angle relative to an axis of the corresponding stress relieving recess.

6. The sealed electrical connector assembly of claim 5 wherein the canted web joins a wall of the corresponding stress relieving recess adjacent the aperture, adjacent an axial location on an opposite side of the core seal gland from the ingress seal gland.

7. The sealed electrical connector assembly of claim 1 wherein the at least one aperture also includes an egress seal gland, with the core seal gland being located between the egress seal gland and the ingress seal gland, the egress seal gland being deformable during passage of an electrical contact through said aperture into a position between the corresponding core seal gland and the contact to prevent damage to the core seal gland by the contact as the contact is extracted from the connector and the seal.

8. The sealed electrical connector assembly of claim 1 wherein the seal includes multiple apertures having both a core seal gland and an ingress seal gland and multiple stress receiving recesses adjacent to the multiple apertures.

9. The sealed electrical connector assembly of claim 1 wherein multiple apertures have a core seal gland adjacent to an ingress seal gland.

10. The sealed electrical connector assembly of claim 1 wherein the ingress seal gland comprises a frangible seal gland iniatially closing the aperture, the frangible seal gland being ruptured as the contact is inserted through the aperture.

11. A sealed electrical conductor assembly for sealingly receiving an electrical contact terminated to an electrical conductor, said sealed assembly comprising:

(a) a seal having a seal surface;

(b) a contact receiving aperture extending into the seal from the seal surface for receiving said contact and said conductor therethrough;

(c) a lead-in recess formed on said seal surface adjacent said contact receiving aperture for receiving said contact;

(d) said contact receiving aperture comprises a plurality of sealing glands including an ingress gland and a core gland;

(e) whereby as said contact is inserted into said contact receiving aperture, said contact is operative to push said ingress gland into engagement with said core gland, whereby said ingress gland is interposed between said core gland and a corner area of said contact, said ingress gland thereby protecting said core gland from tearing as said contact is inserted through said seal.

12. The assembly of claim 11, wherein said contact comprises a front section with an outer dimension greater than an inner diameter of said ingress gland but less than said an inner diameter of said lead-in recess.

13. The assembly of claim 11, wherein said seal is symmetrical relative to said core gland, said seal including a contact egress section and an opposing contact lead-in section, said contact lead-in section includes said lead-in recess, and said contact egress section also includes a recess, formed on another seal surface of said seal, having the same shape as the lead-in recess.

14. A seal for use is sealing wires entering an electrical connector, the seal having a plurality of apertures alignable with cavities in the electrical connector in which electrical contacts are positioned, the electrical contacts being insertable through the seal apertures into the cavities, the seal including sealing glands in each aperture to seal wires extending through the aperture, the seal also including stress relieving recesses adjacent to the apertures, coaxial stress relieving recesses extending inwardly from opposite faces of the seal and being separated by webs located between the opposite faces of the seal, the stress relieving recesses permitting deformation of the seals as the electrical contacts are inserted through the apertures to reduce damage to sealing glands by the electrical contacts.

15. The seal of claim 14 wherein at least a portion of the webs are canted at an acute angle relative to an axis of the corresponding stress relieving recesses.

16. The seal of claim 15 wherein webs in other stress relieving aperture extend perpendicular to an axis of the corresponding stress relieving recesses.

17. The seal of claim 16 wherein stress relieving recesses having webs perpendicular to the axes thereof are located between seal apertures and stress relieving recesses having canted webs are located on the periphery of the seal apertures.

18. The seal of claim 14 wherein the seal apertures including multiple seal glands, the webs being adjacent seal glands located in the center of the apertures.

19. The seal of claim 18 wherein each seal aperture includes an ingress gland, a core gland and an egress gland, the core gland being located between the other two glands.

20. The seal of claim 19 wherein the stress relieving recesses permit deformation of the seal so that the ingress gland protects the core gland from damage as a contact is inserted through an aperture.

21. The seal of claim 14 the seal apertures are located in rows and the recesses are located in rows parallel to the seal apertures.

22. A seal for an electrical connector, comprising an member having a contact receiving aperture with a plurality of sealing glands therethrough, a lead-in recess being formed along an exterior surface of the contact receiving aperture, a frangible gland being disposed adjacent to the exterior surface along the lead-in recess, whereby as an electrical contact is received through the contact receiving aperture, the frangible gland stretches over a forward surface of the contact and protects the sealing glands from engaging the contact and thereby ripping or tearing.

23. A seal for an electrical connector, the electrical connector having a plurality of electrical contacts terminated to a plurality of conductors, the seal providing a sealing relationship around the conductors, the seal having a plurality of contact receiving apertures through which the conductors will be received, the seal having a conductor engaging gland along the contact receiving aperture, the contact receiving aperture having a frangible gland along an exterior surface of the aperture, whereby as an electrical contact is received through the contact receiving aperture, the frangible gland stretches over a forward surface of the contact and protects the conductor engaging gland from engagement with the contact and thereby ripping or tearing.

* * * * *